US006847585B2

(12) United States Patent
Macpherson

(10) Patent No.: US 6,847,585 B2
(45) Date of Patent: Jan. 25, 2005

(54) METHOD FOR ACOUSTIC SIGNAL TRANSMISSION IN A DRILL STRING

(75) Inventor: John D. Macpherson, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/974,960

(22) Filed: Oct. 11, 2001

(65) Prior Publication Data

US 2003/0072217 A1 Apr. 17, 2003

(51) Int. Cl.[7] ..... G01V 1/40; H04R 17/00

(52) U.S. Cl. ..... 367/82; 367/76; 166/73; 175/40; 175/50

(58) Field of Search ..... 367/76, 82; 166/73; 175/40, 46, 50

(56) References Cited

U.S. PATENT DOCUMENTS

| | | | | | |
|---|---|---|---|---|---|
| 3,961,288 | A | | 6/1976 | Gordy | 332/44 |
| 4,293,936 | A | * | 10/1981 | Cox et al. | 367/82 |
| 4,562,559 | A | * | 12/1985 | Sharp et al. | 367/82 |
| 5,128,902 | A | * | 7/1992 | Spinnler | 362/82 |
| 5,148,408 | A | | 9/1992 | Matthews | 367/82 |
| 5,222,049 | A | * | 6/1993 | Drumheller | 367/82 |
| 5,274,606 | A | * | 12/1993 | Drumheller et al. | 367/82 |
| 5,303,203 | A | * | 4/1994 | Kingman | 367/75 |
| 5,321,981 | A | * | 6/1994 | Macpherson | 73/157 |
| 5,600,740 | A | * | 2/1997 | Asfar | 385/27 |
| 6,208,586 | B1 | | 3/2001 | Rorden et al. | 367/35 |
| 6,310,829 | B1 | * | 10/2001 | Green et al. | 367/82 |
| 6,320,820 | B1 | * | 11/2001 | Gardner et al. | 367/81 |
| 2002/0157895 | A1 | * | 10/2002 | Bubinsky et al. | 181/102 |

OTHER PUBLICATIONS

Barnes et al, Journal of Acoustical Society of America, vol. 51, #5, pt. 2, pp 1606–1608, 1972.*

Drumreller et al, Journ. Acoust. Soc. of America, vol. 97, #4, pp 2146–2125, Apr. 1995*

* cited by examiner

*Primary Examiner*—Nelson Moskowitz

(74) *Attorney, Agent, or Firm*—Madan, Mossman & Sriram, P.C.

(57) ABSTRACT

The present invention is a method of transmitting one or more acoustic signals in a drill string using PSK, ASK, FSK or MSFK. The method includes determining one or more stopbands and one or more passbands by testing or modeling the drill string. Two modulating frequencies are selected that are equidistant about a carrier frequency, and which are located within at least one passband. Data representative of downhole measurements or calculations are converted to signals to be transmitted at the modulating frequencies.

19 Claims, 3 Drawing Sheets

METHOD FOR ACOUSTIC SIGNAL TRANSMISSION IN A DRILL STRING

BACKGROUND OF THE INVENTION

1. Field of the Invention

This invention relates generally to signal transmission methods, and more particularly to acoustic data telemetry methods for transmitting data from a downhole location to the surface.

2. Description of the Related Art

To obtain hydrocarbons such as oil and gas, boreholes are drilled by rotating a drill bit attached at a drill string end. Modern directional drilling systems generally employ a drill string having a bottomhole assembly (BHA) and a drill bit at end thereof that is rotated by a drill motor (mud motor) and/or the drill string. A number of downhole devices in the BHA measure certain downhole operating parameters associated with the drill string and the wellbore. Such devices typically include sensors for measuring downhole temperature, pressure, tool azimuth, tool inclination, drill bit rotation, weight on bit, drilling torque, etc. Downhole instruments, known as measurement-while-drilling ("MWD") and logging-while-drilling ("LWD") devices in the BHA provide measurements to determine the formation properties and formation fluid conditions during the drilling operations. The MWD or LWD devices usually include resistivity, acoustic and nuclear devices for providing information about the formation surrounding the borehole.

Downhole measurement tools currently used often, together and separately, take numerous measurements and thus generate large amounts large amounts of corresponding data. Due to the copious amounts of these downhole measurements, the data is typically processed downhole to a great extent. Some of the processed data must be telemetered to the surface for the operator and/or a surface control unit or processor device to control the drilling operations. For example, this processed data may be used to alter drilling direction and/or drilling parameters such as weight on bit, drilling fluid pump rate, and drill bit rotational speed. Mud-pulse telemetry is most commonly used for transmitting downhole data to the surface during drilling of the borehole. However, such systems are capable of transmitting only a few bits of information per second, e.g., 1–4 BPS. Due to such a low transmission rate, the trend in the industry has been to attempt to process greater amounts of data downhole and transmit only selected computed results or "answers" uphole for controlling the drilling operations. Still, the data transmission requirements far exceed the capabilities the current mud-pulse and other telemetry systems.

Acoustic telemetry systems have been proposed for higher data transmission rates. Piezoelectric materials such as ceramics began the trend, and advancements in the use of magnetostrictive material has potentially enabled even more efficient transmitting devices. These devices operate on the general concept of creating acoustic energy with an actuator having one of the above materials.

The created acoustic energy is modulated in frequency, phase, amplitude or in any combination of these, so that the acoustic energy contains information about a measured or calculated downhole parameter of interest. The acoustic energy is transferred into a drillstring thereby setting up an acoustic wave signal. The acoustic signal propagates along the drillstring and is received by a receiver. The receiver is coupled to a controller for processing and/or recording the signal. In deep well applications, there may be one or more intermediate transmitters disposed along the drillstring to facilitate signal transmission over the longer distance.

Although acoustic telemetry provides data rate benefits not capable in mud-pulse telemetry, conventional acoustic telemetry methods suffer from physical limitations existing within the transmission medium, i.e., the drillstring. In particular, a drill pipe having jointed pipes pose special problems for the conventional methods of acoustic transmission.

Due to necessarily repetitive spacing of tool joints within the drillstring, the drillstring exhibits certain acoustic properties. One of the most important of these is the presence of frequency bands in which there is severe attenuation of acoustic signals. These frequency bands occur repetitively in the frequency spectrum (rather like the tines on a comb) and are referred to as stopbands. The intervals in between these stopbands are referred to as passbands. Acoustic energy may be transmitted along the drillstring when the signal frequency is within one of the passbands.

A known method of transmitting a message signal along the drillstring is using pulses of acoustic energy to represent the digital information. This is a form of telemetry using amplitude modulation (also referred to as ASK or Amplitude Shift Keying) to encode information about the downhole parameter of interest. Exemplary methods include the use of signal switching between "off" and "on" states to represent binary states, or the use of high amplitude, broad frequency bandwidth, "shock" pulses. These methods suffer from high error or data "drops" and low transmission rates caused by the inability of receiving and processing circuits to distinguish the data signals. This is due to high levels of background noise caused by drilling vibrations, or to echoes of the transmitting signals within the drillstring.

The present invention addresses the drawbacks identified above by determining one or more frequency ranges for natural stopbands of a drill string and selecting a modulating frequency based on the frequency ranges of the stopbands for transmitting data signals.

SUMMARY OF THE INVENTION

To address some of the deficiencies noted above, the present invention provides a method for transmitting a signal from a downhole location through the drill or production pipe. The present invention also provides a method of transmitting a signal in a pipe used for MWD, completion wells or production wells using an actuator for generating acoustic energy to induce an acoustic wave indicative of a parameter of interest into a drill pipe or production pipe.

In one aspect of the present invention a method of transmitting an acoustic signal through a drill pipe is provided. The method comprises determining one or more passbands and one or more stopbands exhibited by the drill pipe. One or more acoustic signals are generated such that at least one acoustic signal has a frequency within the passband. The at least one acoustic signal is then transmitted through the drill pipe.

Another aspect of the present invention is a method of transmitting a signal from a first location within a well borehole to a second location through a transmission medium having one or more passbands separated by one or more stopbands. The method comprises determining limiting frequencies associated with the one or more stopbands, generating at least two signals, each signal having an associated frequency, the frequency being within the one or more passbands, and transmitting the at least two signals from the first location to the second location through the transmission medium.

In the several aspects of the present invention, transmissions such as phase-shift keying, frequency-shift keying, and amplitude shift keying are used to transmit acoustic signals in a drill pipe. These methods may be combined depending on particular transmission characteristics desired.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENTS

Figure 1:
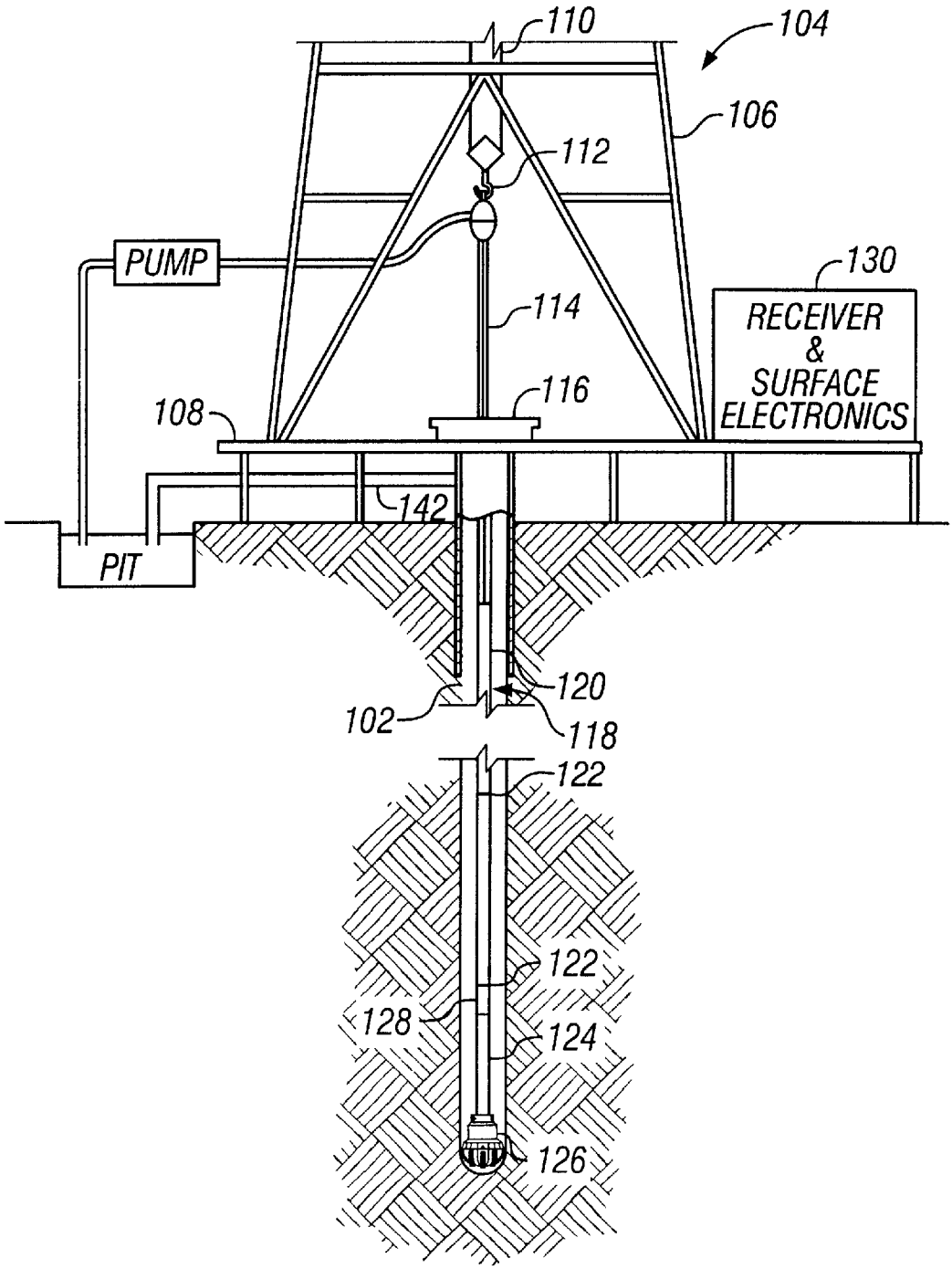
FIG. 1 is an elevation view of a simultaneous drilling and logging system that may be used in a preferred method according to the present invention.

FIG. 1 is an elevation view of a simultaneous drilling and logging system that may be used in a preferred method according to the present invention. A well borehole 102 is drilled into the earth under control of surface equipment including a rotary drilling rig 104. In accordance with a conventional arrangement, the rig 104 includes a derrick 106, a derrick floor 108, draw works 110, a hook 112, a kelly joint 114, a rotary table 116, and drill string 118. The drill string 118 includes drill pipe 120 secured to the lower end of kelly joint 114 and to the upper end of a section comprising a plurality of pipes joined in a conventional manner such as threaded pipe joints ("collars") 122. A bottom hole assembly (BHA) 124 is shown located down hole on the drill string 118 near a drill bit 126.

The BHA 124 carries various sensors (not separately shown) for measuring formation and drilling parameters. An acoustic transmitter 128 may be carried by the BHA 124 or above the BHA 124. The transmitter 128 receives signals from the sensors and converts the signals to acoustic energy. The acoustic energy is transferred to the drill string 118 and an acoustic wave signal travels along the drill string 118 and is received at the surface by a receiver 130.

The present invention utilizes acoustic telemetry to transmit data signals comprising one or more signals modulated at predetermined frequencies and amplitudes. In a system such as the system shown in FIG. 1, the drill string 118 will exhibit certain frequency response characteristics due to acoustic wave reflections caused by geometry change at each tool joint or collar 122.

Figure 2:
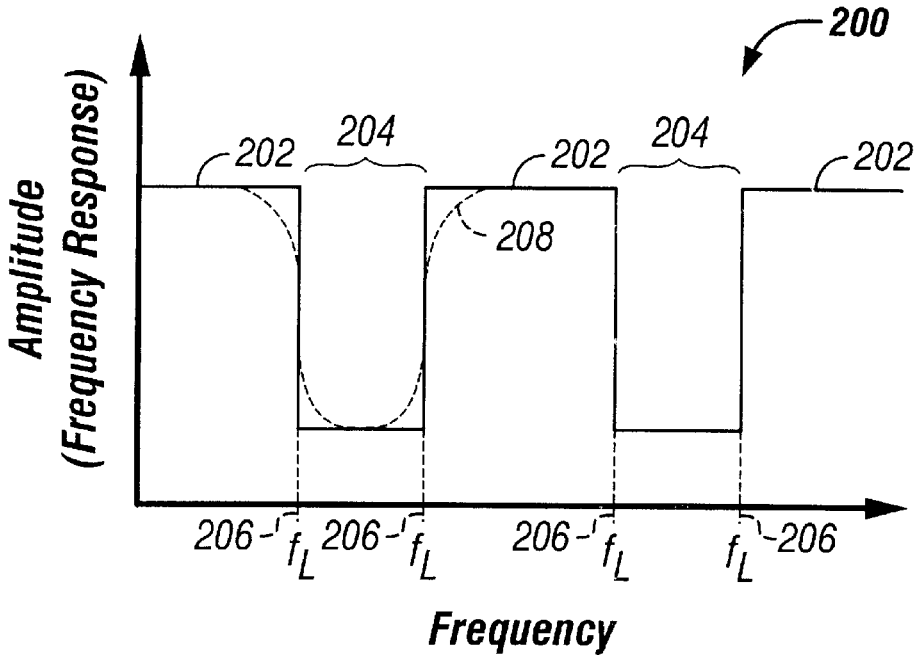
FIG. 2 is a typical frequency response curve of a drill string such as the drill string of FIG. 1A.

Referring now to FIGS. 1 and 2, the reflections at each collar 122 create a determinable frequency response of signal amplitude with respect to transmitted frequency. The curve of FIG. 2 illustrates the frequency response of a typical jointed pipe drill string. The curve 200 includes a plurality of passbands 202 and a plurality of stopbands 204 defined at limiting frequencies $f_L$ 206. Those skilled in the art would understand that an actual signal response 208 would not have sharp corners at the limiting frequencies.

Passband, as used herein, is defined as a portion of a frequency spectrum between limiting frequencies within which signals will transmit ("pass") with low relative attenuation or high relative gain with respect to the output amplitude of the signal transmitter. Limiting frequencies as used herein are defined as those frequencies at which the relative signal amplitude attenuates ("decreases") to a specified fraction of the maximum intensity or power within the passband. The level of decrease in power is often selected to be the half-power point, i.e., −3 dB.

Stopband, as used herein, is defined as a portion of a frequency spectrum between limiting frequencies within which signals will not transmit, i.e., the signal will have high relative attenuation with respect to the output amplitude of the signal transmitter.

Figure 3:
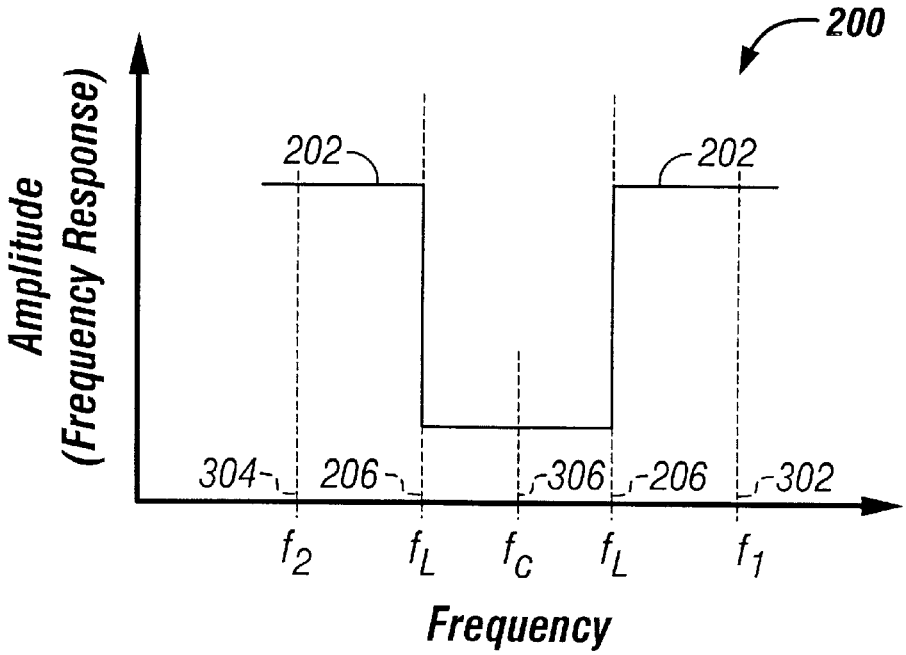
FIG. 3 shows a portion of the frequency response curve of FIG. 2 with carrier and signal frequencies used in an embodiment of the present invention.

Referring now to FIG. 3, a preferred method according to the present invention is shown. The method includes placing a carrier frequency $f_c$ 306 within the transmission stopband 204, while one or more data transmission frequencies 302 and 304 are used for transmitting data signals. In this manner carrier frequency 306 is removed from the transmitted signal.

The present method includes determining the frequencies used for carrier signals $f_c$ 306 and data signals f1 and f2 302 and 304 by determining the limiting frequencies or ("transition frequencies") $f_L$ 206 that define upper and lower limits of the stop and passbands 204 and 202. The transition frequencies are preferably determined through modeling of the drillstring 118. The data signals are then generated at frequencies 302 and 304 using the signal transmitter 128. These data signals preferably represent distinct binary states "0" and "1". The data signals are transmitted in serial fashion to create a string of signals indicative of a downhole-measured parameter. The serial data signals are received and decoded at the surface using the receiver 130.

Determining the stopbands 204 and passbands 202 may be accomplished in accordance with the present invention. The drillstring is modeled by dividing the string into alternating sections of tool joints and sections of pipe body. Each of the sections will have associated lengths, and external and internal diameters. The acoustic transmission properties are then calculated using a software model. The physical properties and dimensions of the drillstring are known prior to running the drillstring, and do not change during drilling. The only difference is that pipe sections with the same dimensions and properties are added while drilling. Therefore the location of the stopbands (and herce the passbands) is known accurately prior to transmission, and prior to running the drillstring into the hole.

Figure 4:
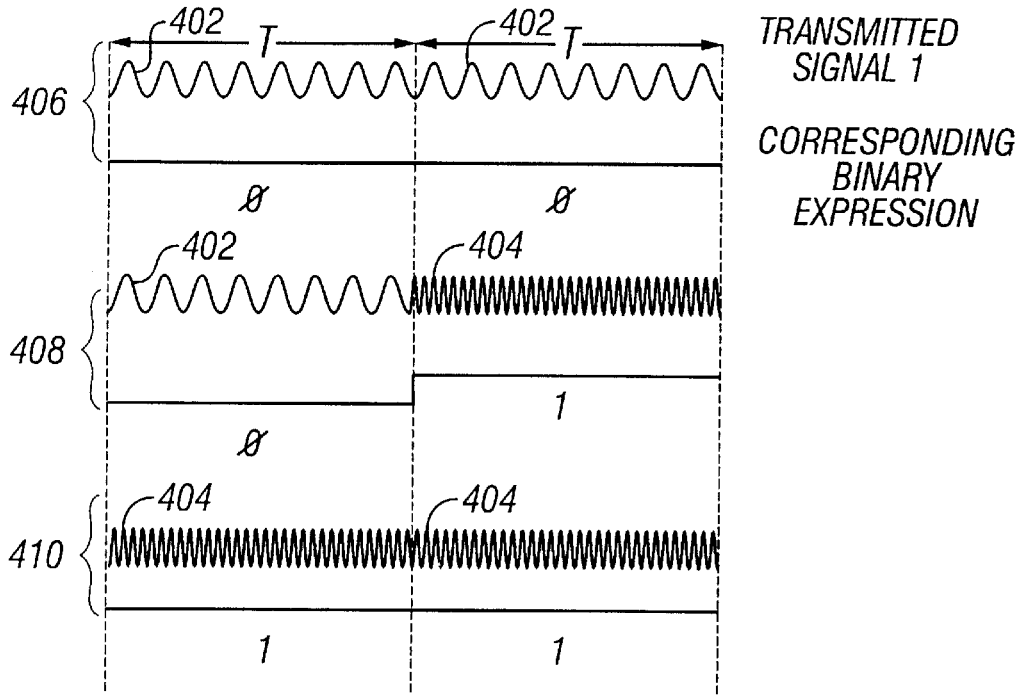
FIG. 4 shows exemplary signal patterns used to transmit binary states via acoustic telemetry.

FIG. 4 shows exemplary signal patterns used to transmit binary states via acoustic telemetry. As shown, a first signal 402 has a predetermined frequency and amplitude representing a binary "0" state. A second signal 404 has a predetermined frequency and amplitude representing a binary "1" state. The second signal 404 may, for example, be twice the frequency of the first signal 402 while having substantially the same amplitude. These signals are transmitted serially to form binary expressions 406, 408 and 410. The expression is formed by transmitting the first or second signal for a defined period T. The first signal is followed by transmitting another signal (either "1" or "0") for an equivalent period T. Those skilled in the art would recognize that any number of data signals may be serially or otherwise transmitted to form any binary expression of desired length. And the use of well-known techniques of transmitting binary expressions such as those shown in FIG. 4 to represent start and stop bits are considered within the scope of this invention.

Any suitable method of generating a plurality of data signals may be used without departing from the scope of the present invention because the structure of frequency response consisting of alternating stopbands and passbands is seen regardless of whether a longitudinal or torsional acoustic wave is propagated along the drillstring. Longitudinal acoustic waves might be generated by, for example, alternately cyclically applying a load along the length of the drillstring. Torsional waves might be generated, for example, by cyclically twisting the drillstring. In a preferred method, frequency shift keying ("FSK") is used to generate at least two frequency-dependent signals representing binary states of "1" and "0".

This method has several advantages, among which are lower inter-symbol interference in the transmission path, and more robust decoding at the receiver due to increased transmission bandwidth and higher signal-to-noise ratio at the receiver. The acoustic stopband in the drillstring removes carrier energy from within the signal bandwidth (a form of signal transmission known as "suppressed carrier" transmission). This results in the removal of non-information carrying energy that might induce distortion (inter-symbol interference) from within the signaling bandwidth.

A well-known theorem in data transmission is Shannon's theorem that states that the maximum possible information rate in a channel (the channel capacity) is given by:

$$C=W\log_2(1+S/N)$$

Here C is information rate in bits-per-second, W is transmission bandwidth in cycles per second and S/N is the signal-to-noise ratio of the average power within the transmission bandwidth. For low data transmission rates, the transmission bandwidth is approximated by the difference between the messaging frequencies $f_1$ and $f_2$:

$$C\approx(f_1-f_2)\log_2(1+S/N)$$

In order to achieve an increase in information rate (C), the bandwidth can be increased, or the S/N ratio at the receiver can be increased, or both. Placing the carrier frequency in the middle of the acoustic stopband allows the use of an increased transmission bandwidth, since the messaging frequencies can be placed anywhere within the passbands on either side of the stopband, maximizing transmission bandwidth. For example, if a stopband of width $S_B$ Hertz has two adjacent passbands each of width $P_B$ Hertz, then the maximum signaling bandwidth using a single passband is $P_B$ Hertz. However, if the carrier is placed in the center of the stopband then the available bandwidth is $2P_B+S_B$. In other words, the maximum available signal bandwidth is increased by a factor greater than 2.

If the acoustic stopband lies at the center of the transmission bandwidth, then all downhole drilling noise at frequencies coincident with the stopband will be removed by the acoustic stopband from the signal seen at the receiver. This will result in an increased signal-to-noise ratio at the receiver when compared to the case of placing the carrier within the passband. The increase in signal to noise ratio is given by a factor:

$$\frac{1}{1-\frac{S_b}{f_1-f_2}}$$

Thus, if the messaging frequencies are placed close to the limiting frequencies then the maximum signal to noise ratio improvement is achieved. The impact of both the signal-to-noise ratio improvement, and the increased bandwidth, is the ability to transmit either at higher data rates from a given depth, or at a given data rate from deeper depths.

Alternatively, other data transmission methods may be utilized without departing from the scope of the present invention. For example, phase-shift keying (PSK) in which data are transmitted at frequencies grouped about an acoustic stopband in the drillstring. PSK may be used rather than FSK. PSK is similar in many respects to FSK, but with the signal phase being shifted to create distinguishable signals. In phase-shift keying, a constant carrier is used. However, more than one carrier can be used and grouped around a stopband so that both bandwidth and signal-to-noise ratio are increased, as in the FSK example given previously.

Amplitude Shift Keying (ASK) is used in another embodiment of the present invention. As discussed above, Amplitude Shift Keying (ASK) is used to transmit only a single frequency is used to transmit information. For example, if the frequency is present then a binary-1 is decoded. If absent, then a binary-0 is decoded. For electromechanical transmitters turning-off the device to encode a binary-0 may lead to slow bit rates since the maximum bit rate will be controlled by the inertia of the device. In the present invention and ASK embodiment, ASK transmission is used as a special form of FSK (with two frequencies). In this embodiment, one of the frequencies placed within the acoustic stopband of the drillstring. This effectively removes the signal for transmitting a binary-0, but allows the electromechanical device to be simply slowed down, rather than stopping, thereby increasing the potential data rate.

In another method according to the present invention utilizes an alternative method of data transmission. In this embodiment, limiting frequencies are determined through modeling of the drill string as described above. Then, two or more data signals are generated within a passband thereby increasing the effective data rate of transmission. In one embodiment, multi-frequency shift keying is used to transmit the data signals.

Effective data rate is increased by using use multiple passbands in another method according to the present invention. In this embodiment, limiting frequencies are determined through modeling of the drill string as described above. Then, one or more carrier frequencies are placed within at least one stopband and data signals representing binary states are generated in multiple passbands. For example, two separate passbands may be used to send signals representing binary "0" for two digits, while two other passbands are used to transmit signals representing binary "1" for two more digits.

Figure 5:
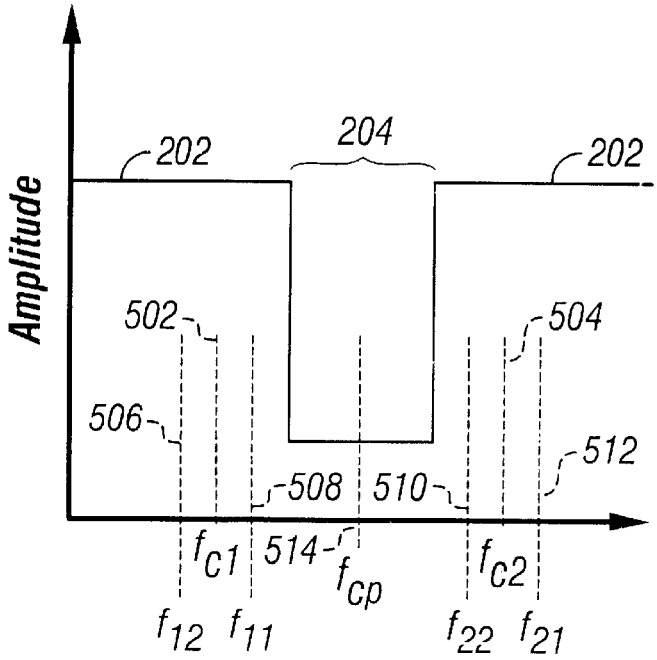
FIG. 5 shows a portion of the frequency response curve of FIG. 2 with multiple carrier and signal frequencies used in an alternative embodiment of the present invention.

FIG. 5 shows another embodiment of the present invention. In this embodiment, limiting frequencies $f_L$ 206 are determined through modeling of the drill string as described above. A carrier frequency 502 and 504 is placed within each passband 202. And data signals representing binary states are generated for each carrier $f_{c1}$ and $f_{c2}$. The data signal frequencies $f_{12}$ and $f_{11}$ 506 and 508 corresponding to carrier frequency $f_{c1}$, 502 are selected to be within the same passband as the carrier $f_{c1}$. Likewise, the data signal frequencies $f_{22}$ and $f_{21}$ 510 and 512 corresponding to carrier frequency $f_{c2}$ 504 are selected to be within the same passband as the carrier $f_{c2}$. In this manner, a prime carrier frequency $f_{CP}$ 514 is within a stopband 204 and each of the plurality of passbands may be utilized to transmit two distinct signals representing binary states.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A method of transmitting an acoustic signal through a drill pipe, the method comprising:

(a) determining one or more passbands exhibited by the drill pipe;

(b) determining one or more stopbands exhibited by the drill pipe;

(c) generating one or more acoustic signals about a carrier frequency; and (d) transmitting the one or more acoustic signals through the drill pipe using the one or more stop bands to attenuate at least one of i) the one or more acoustic signals and ii) the carrier frequency.

2. The method of claim 1 wherein the one or more acoustic signals are at least on of (i) a longitudinal acoustic wave and (ii) a torsional acoustic wave.

3. The method of claim 1, wherein the one or more acoustic signals include a first data signal and a second data signal.

4. The method of claim 1, wherein the one or more acoustic signals include a first data signal and a second data signal, the first and second data signals being separated equidistant from the carrier frequency.

5. The method of claim 4, wherein the first and second data signals are generated to represent binary states.

6. The method of claim 4, wherein the first and second data signals are generated such that the frequencies of the data signals and the frequency of the carrier are all within the same passband.

7. The method of claim 4, wherein determining the one or more passbands is determining two or more passbands separated by stopbands, the first and second data signals being generated such that the frequency of each data signal is in a unique passband and the carrier frequency is in the stopband.

8. The method of claim 1, wherein transmitting the one or more acoustic signals is performed using one of (i) FSK, (ii) MSFK, (iii) PSK, and (iv) ASK.

9. A method of transmitting a signal from a first location within a well borehole to a second location through a transmission medium having one or more passbands separated by one or more stopbands, the method comprising:

(a) determining limiting frequencies associated with the one or more stopbands;

(b) generating at least two signals, each signal having an associated frequency and a carrier frequency; and (d) transmitting the at least two signals from the first location to the second location through the transmission medium, wherein the stopbands are used to attenuate at least one of i) the at least two signals and ii) the carrier frequency.

10. The method of claim 9, wherein the transmission medium is a jointed pipe.

11. The method of claim 9, wherein the at least two signals are transmitted to represent binary states.

12. The method of claim 9, wherein the frequency of each signal is in a separate passband, the frequency of the signals being equidistant from the carrier frequency located within a stopband.

13. The method of claim 9, wherein the frequency of each signal is in a passband, the frequency of the signals being equidistant from the carrier frequency located within a passband.

14. The method of claim 9, wherein transmitting the at least two signals is performed using one of (i) FSK, (ii) MSFK, (iii) PSK and (iii) ASK.

15. An apparatus for transmitting an acoustic signal through a pipe, said pipe exhibiting one or more passbands and one or more stopbands, the apparatus comprising a signal transmitter transmitting data signals separated from at least one carrier frequency such that the one or more stop bands attenuate at least one of i) the data signals and ii) the carrier frequency.

16. The apparatus of claim 15, further comprising a receiver disposed to receive the transmitted data signals.

17. The apparatus if claim 15, wherein the pipe is one of i) a drill pipe and ii) a production well pipe.

18. The apparatus of claim 15, wherein the pipe is disposed in a deep well, the apparatus further comprising an intermediate transmitter disposed on the pipe between the at least one transmitter and the surface.

19. The apparatus of claim 15, wherein the transmitter transmits the data signals using one of (i) FSK, (ii) MSFK, (iii) PSK and (iii) ASK.

* * * * *